US011286691B2

(12) United States Patent
Kurki et al.

(10) Patent No.: US 11,286,691 B2
(45) Date of Patent: Mar. 29, 2022

(54) CYLINDER LOCK

(71) Applicant: ABLOY OY, Joensuu (FI)

(72) Inventors: Antti Kurki, Niittylahti (FI); Pauli Havukainen, Ylämylly (FI); Matthias Daubitz, Berlin (DE); Markus Wahl, Potsdam Fahrlan (DE)

(73) Assignee: ABLOY OY, Joensuu (FI)

( * ) Notice: Subject to any disclaimer, the term of this patent is extended or adjusted under 35 U.S.C. 154(b) by 400 days.

(21) Appl. No.: 16/500,272

(22) PCT Filed: Apr. 4, 2017

(86) PCT No.: PCT/FI2017/050239
§ 371 (c)(1),
(2) Date: Oct. 2, 2019

(87) PCT Pub. No.: WO2018/185360
PCT Pub. Date: Oct. 11, 2018

(65) Prior Publication Data

US 2020/0291686 A1 Sep. 17, 2020

(51) Int. Cl.

| | |
|---|---|
| ***E05B 47/06*** | (2006.01) |
| ***E05B 21/06*** | (2006.01) |
| ***E05B 47/00*** | (2006.01) |
| ***G07C 9/00*** | (2020.01) |

(52) U.S. Cl.
CPC ..... *E05B 47/063* (2013.01); *E05B 21/066* (2013.01); *E05B 47/0634* (2013.01); *G07C 9/00174* (2013.01); *E05B 2047/0062* (2013.01); *G07C 2009/00634* (2013.01)

(58) Field of Classification Search
CPC .. E05B 47/063; E05B 21/066; E05B 47/0634; E05B 2047/0062; E05B 2047/002; G07C 9/00174; G07C 2009/00634
USPC ..... 70/495, 277, 278.1–278.3, 278.7, 279.1, 70/283.1
See application file for complete search history.

(56) References Cited

U.S. PATENT DOCUMENTS

| | | | | |
|---|---|---|---|---|
| 5,265,452 | A | 11/1993 | Dawson et al. | |
| 6,776,016 | B1 * | 8/2004 | Wittwer | B60R 25/24 70/252 |
| 8,228,030 | B2 * | 7/2012 | Pukari | G07C 9/00309 320/114 |

(Continued)

FOREIGN PATENT DOCUMENTS

| | | | |
|---|---|---|---|
| CN | 101315001 | A | 12/2008 |
| CN | 201416301 | Y | 3/2010 |

(Continued)

*Primary Examiner* — Lloyd A Gall
(74) *Attorney, Agent, or Firm* — Muncy, Geissler, Olds & Lowe, P.C.

(57) ABSTRACT

The cylinder lock according to the invention includes a body and, inside it, an inner cylinder unit provided with an inner cylinder. The cylinder lock also includes a generator for generating electricity from the movement of a key inserted in the cylinder lock. The electricity generated is used to identify the key, and the electricity generated is also used in the electric device if opening the cylinder lock is allowed on the basis of the identification of the key. In connection with the generator are also generator shaft system, a channel axis and transmission parts from the channel axis to the generator.

44 Claims, 8 Drawing Sheets

(56) References Cited

U.S. PATENT DOCUMENTS

Figure 1:
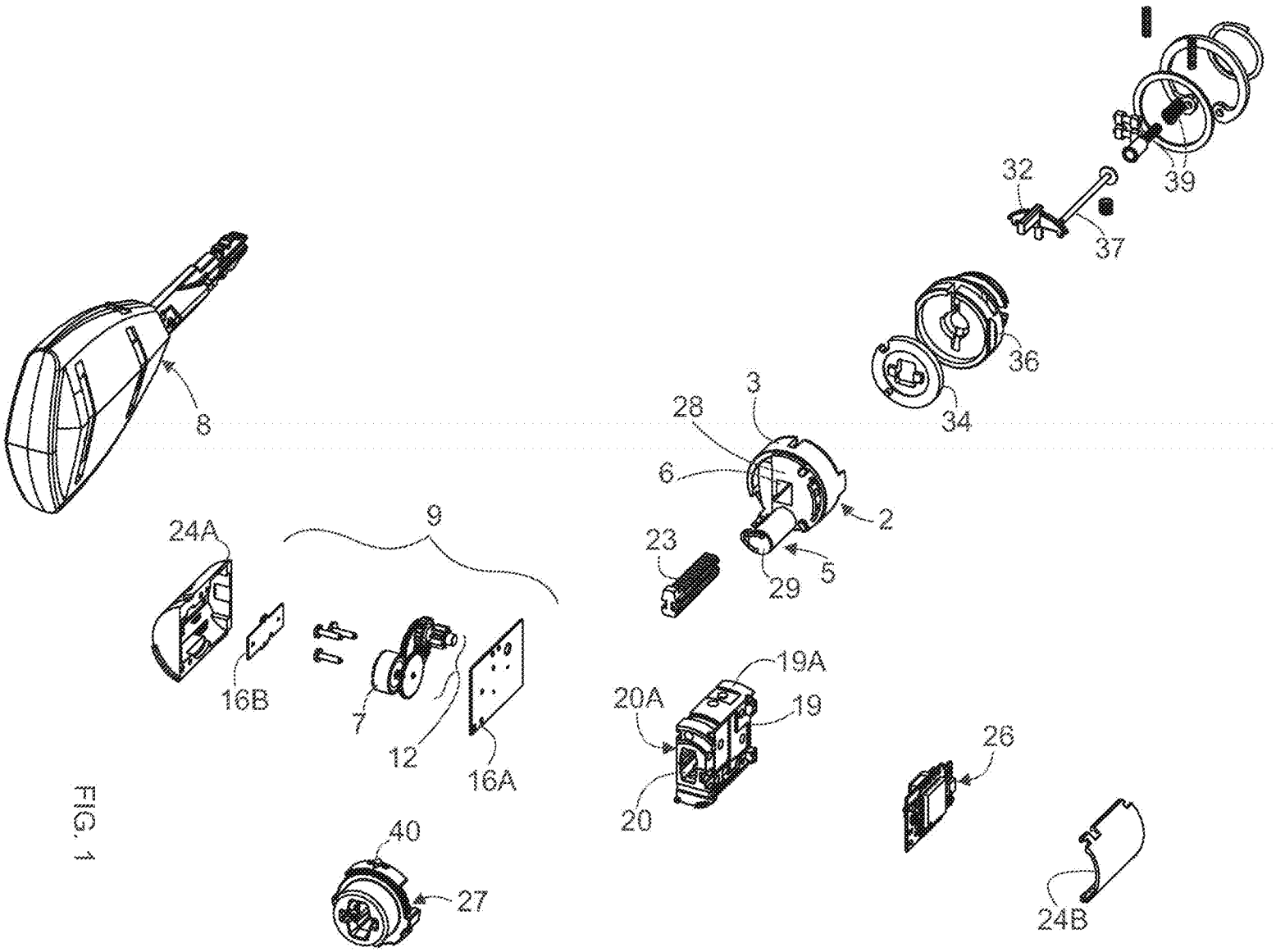

| | | | | |
|---|---|---|---|---|
| 8,468,861 | B2 * | 6/2013 | Pukari | G07C 9/00309 70/278.7 |
| 8,581,690 | B2 * | 11/2013 | Lappalainen | E05B 47/0611 340/5.1 |
| 8,899,081 | B2 * | 12/2014 | Pukari | E05B 47/0012 70/277 |
| 11,168,493 | B2 * | 11/2021 | Kellokoski | E05B 47/02 |
| 2010/0188190 | A1 * | 7/2010 | Pukari | E05B 47/063 340/5.6 |

FOREIGN PATENT DOCUMENTS

| | | | |
|---|---|---|---|
| WO | WO9918310 | A1 | 4/1999 |
| WO | WO2006/008340 | A1 | 1/2006 |

* cited by examiner

FIG. 3
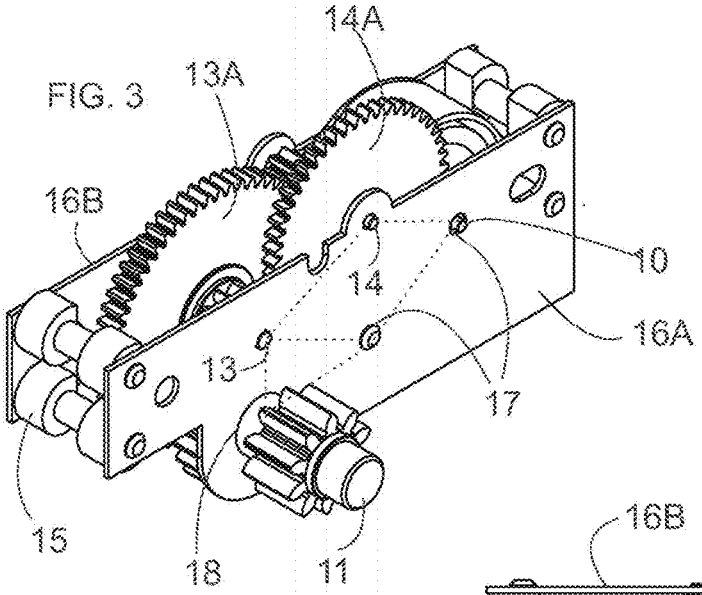
FIG. 4
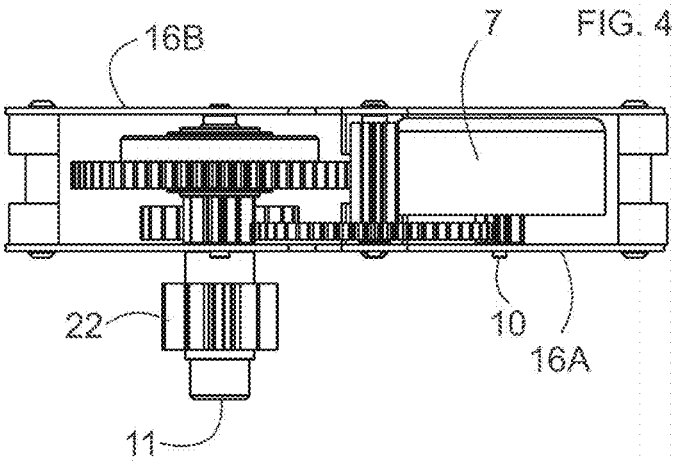
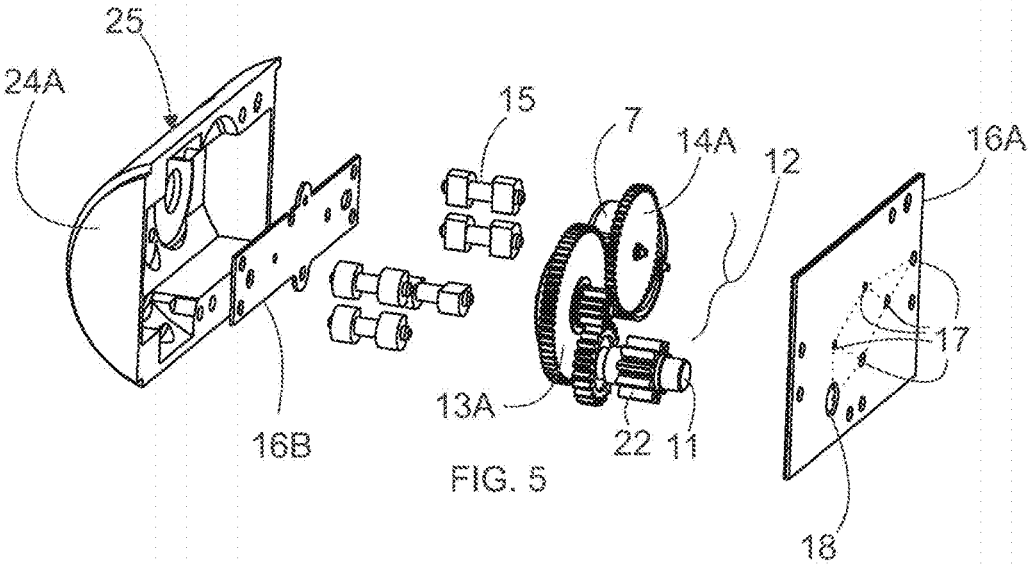
FIG. 5

CYLINDER LOCK

TECHNICAL FIELD

The present invention relates to a cylinder lock provided with electric means which allow a tumbler in the cylinder lock to be guided from a locking position into an opening position. The cylinder lock is further provided with a generator for generating electricity from the movement of a key inserted in the cylinder lock.

PRIOR ART

It is known that a cylinder lock comprises a body and, inside it, an inner cylinder unit. The inner cylinder unit may be provided with an inner cylinder, a tumbler and electric means. The electric means allow the tumbler to be guided from a locking position into an opening position. The tumbler prevents the inner cylinder from being turned with respect to the body in the locking position and allows the inner cylinder to be turned with respect to the body in the opening position. In addition, known inner cylinders include a channel for a key.

It is also known that a cylinder lock may also comprise a generator for generating electricity from the movement of the key inserted in the cylinder lock. The publication WO 9918310 discloses a lock cylinder of this type. The electricity generated is used to identify the key and the electricity generated is further used in the electric means if opening the cylinder lock is allowed on the basis of the identification of the key. Manufacturing this type of a cylinder lock is demanding since the parts must be positioned precisely with respect to one another. The tolerances between the parts must be small in order for a lock cylinder provided with a generator to function properly. Due to these factors, manufacturing a cylinder lock is expensive and requires great care and precision. Furthermore, the structure described above is not necessarily applicable to all cylinder lock types.

BRIEF DESCRIPTION OF THE INVENTION

The object of the invention is to achieve a cylinder lock provided with a generator, the manufacture of which cylinder lock is cheaper and even faster compared to known cylinder locks. This object is achieved in the manner disclosed in the independent claim.

The cylinder lock 100 according to the invention comprises a body 1 and, inside it, an inner cylinder unit 2 provided with an inner cylinder 3, a tumbler 4 and electric means 5. The electric means allow the tumbler 4 to be guided from a locking position into an opening position. The tumbler 4 prevents the turning of the inner cylinder 3 with respect to the body 1 in the locking position and allows the inner cylinder to be turned with respect to the body in the opening position. There is also a channel 6 inside the inner cylinder.

The cylinder lock also comprises a generator 7 for generating electricity from the movement of the key 8 inserted in the cylinder lock. The electricity generated is used to identify the key 8, and the electricity generated is also used in the electric means 5 if opening the cylinder lock 100 is allowed on the basis of the identification of the key. In connection with the generator 7 is a generator shaft system 10. The cylinder lock also comprises a channel axis 11 and transmission parts 12 from the channel axis to the generator. The cylinder lock further comprises a key channel module 19 with a key channel 20 and an opening 21 from its side surface 20A into the key channel.

The cylinder lock also comprises a key channel module 19 with a key channel 20 and an opening 21 from its side surface 20A into the key channel. The key channel 20 and the channel 6 inside the inner cylinder form a joint channel 20, 6. In the key channel module opening 21 is positioned a part of the channel axis 11, which extends into the key channel 20. The channel axis comprises a gearwheel 22 which is in the key channel 2. The channel axis 11 is arranged to rotate by the movement of the key 8 inserted in the cylinder lock.

The generator shaft system 10, the channel axis 11, the transmission parts 12 and the key channel module 19 are, therefore, connected to the inner cylinder 3 such that they are arranged to turn with the inner cylinder.

In the cylinder lock is also located a circuit board 26 provided with a memory for identifying the key, and also for conveying the electricity generated to the electric means 5 if opening the cylinder lock is allowed on the basis of the identification of the key.

The cylinder lock also comprises at least one curved protective cover 24A, between which protective cover and the key channel module 19 are located the channel axis 11, the transmission parts 12, the generator shaft system 10 and the generator 7, as well as the key channel module 19.

It is, however, possible that the cylinder lock also comprises a second protective cover 24B, in which case the channel axis 11, the transmission parts 12, the generator shaft system 10 and the generator 7, as well as the key channel module 19 are located between the protective covers. A circuit board 26 may also be located between the protective covers. The protective covers form sliding support surfaces 25 with respect to the body 1. The support surfaces 25 and the outer surfaces of the inner cylinder form a convergent curved surface area. The protective covers may thus be curved.

The idea of the invention is that the structure of the cylinder lock is such that the generator may be connected in conjunction with the inner cylinder, such that it rotates with the inner cylinder. This structure is applicable to several different types of lock cylinders. The structure is, in addition, relatively simple and more economical compared to earlier solutions.

LIST OF FIGURES

Figure 2:
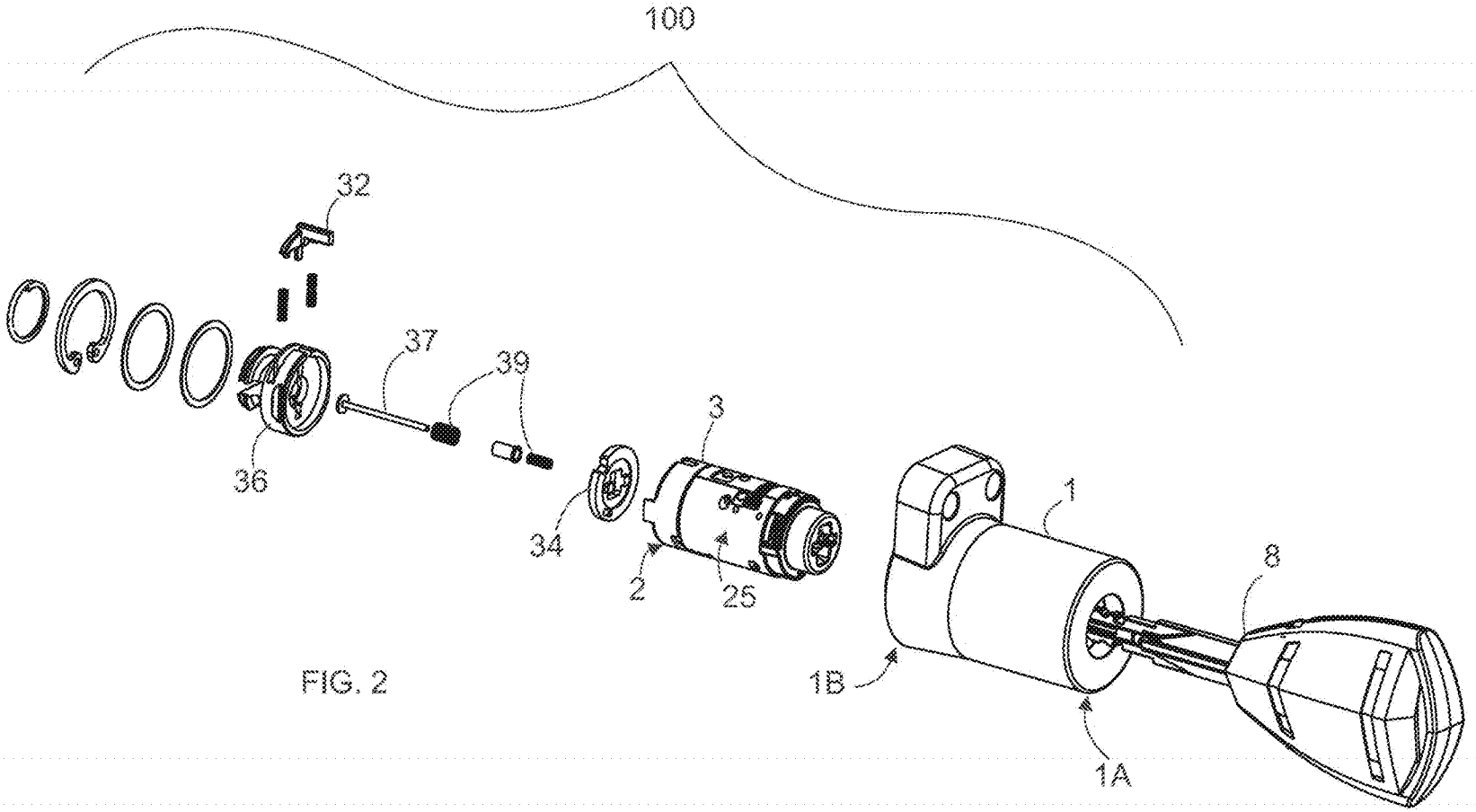
Figure 6:
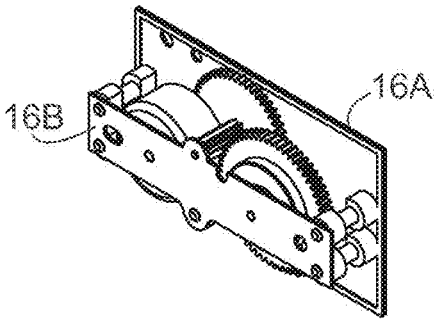
Figure 7:
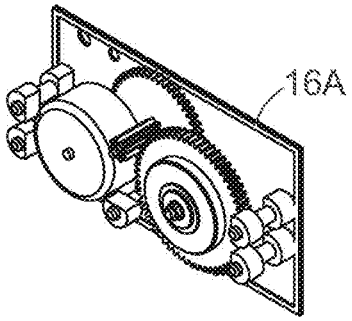
Figure 8:
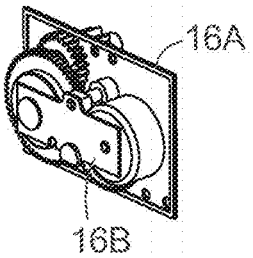
Figure 9:
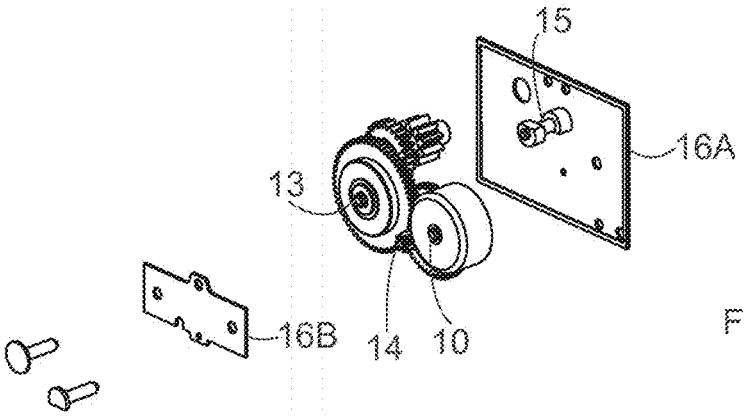
Figure 10:
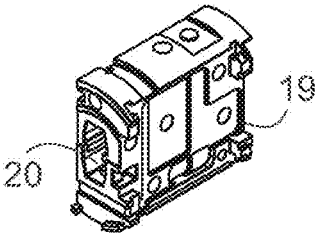
Figure 11:
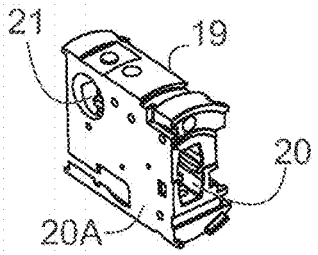
Figure 12:
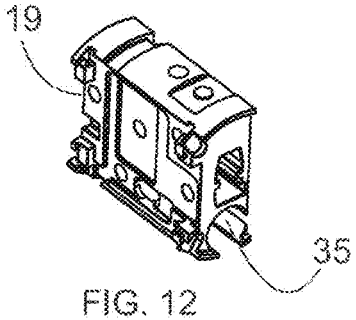
Figure 13:
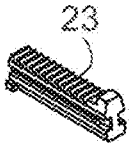
Figure 14:
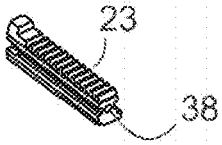
Figure 15:
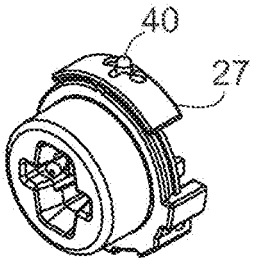
Figure 16:
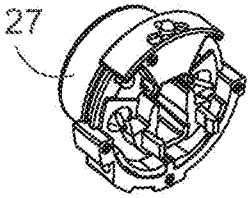
Figure 17:
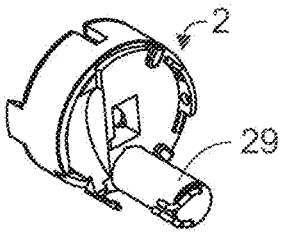
Figure 18:
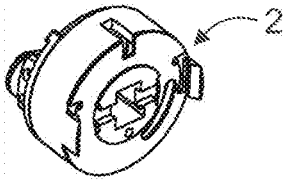
Figure 19:
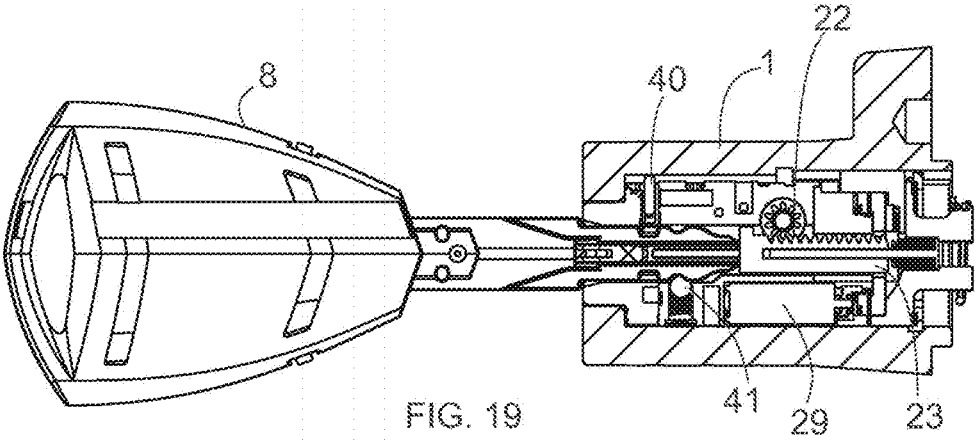
Figure 20:
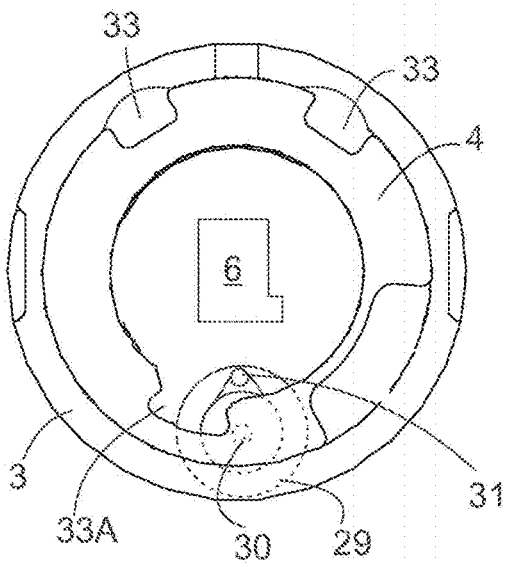
Figure 21:
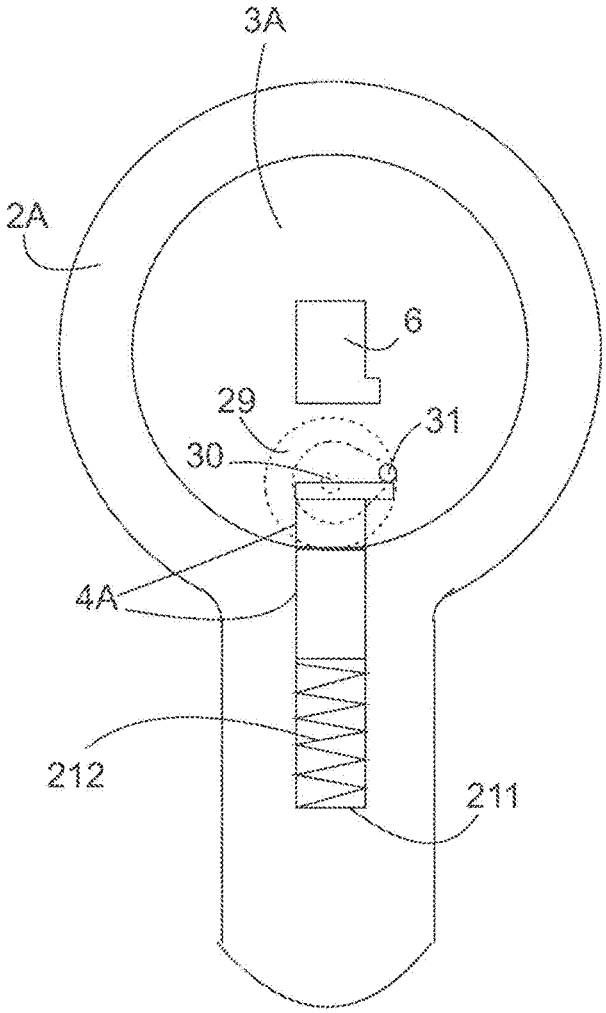
Figure 22:
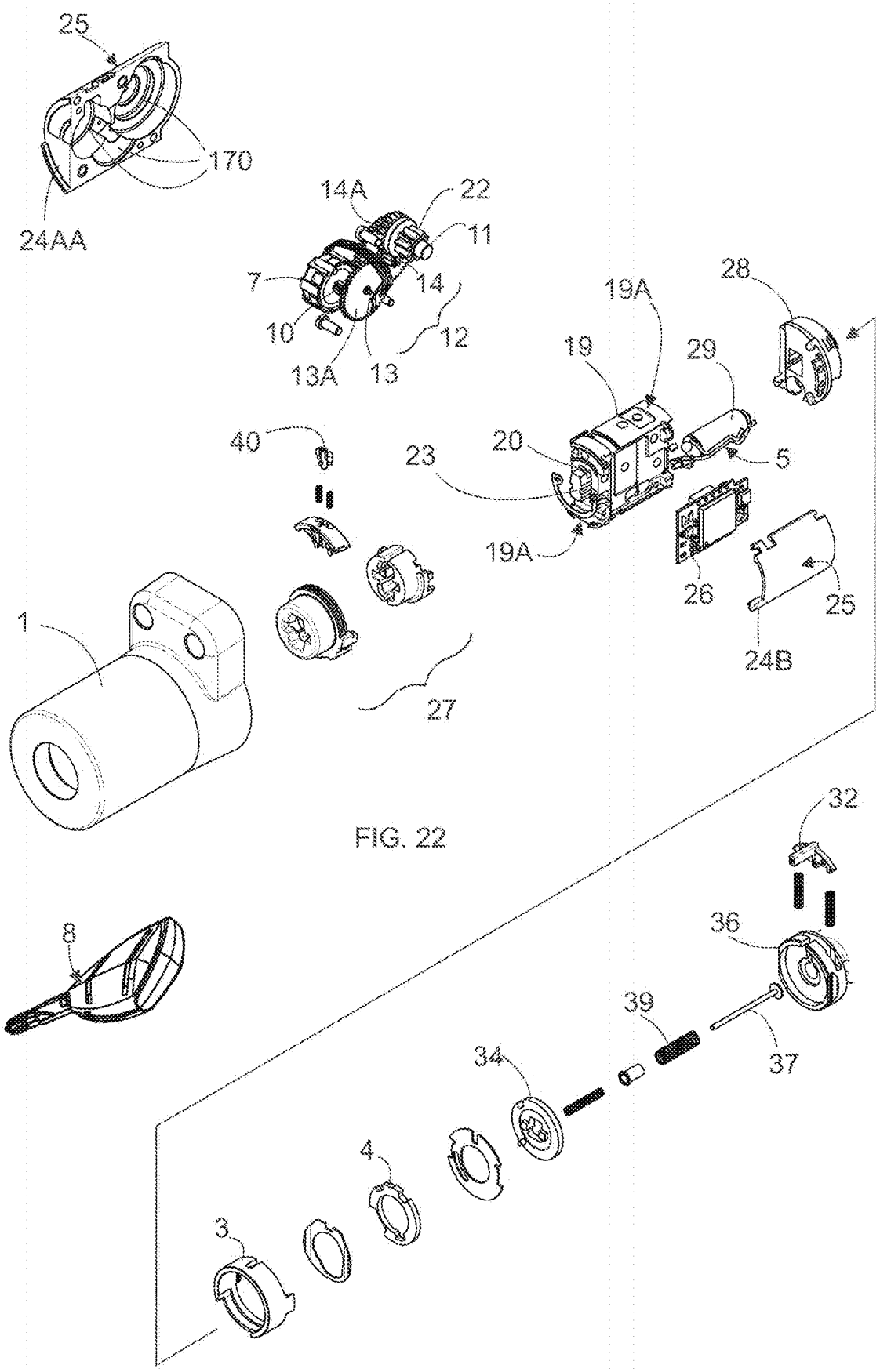
Figure 23:
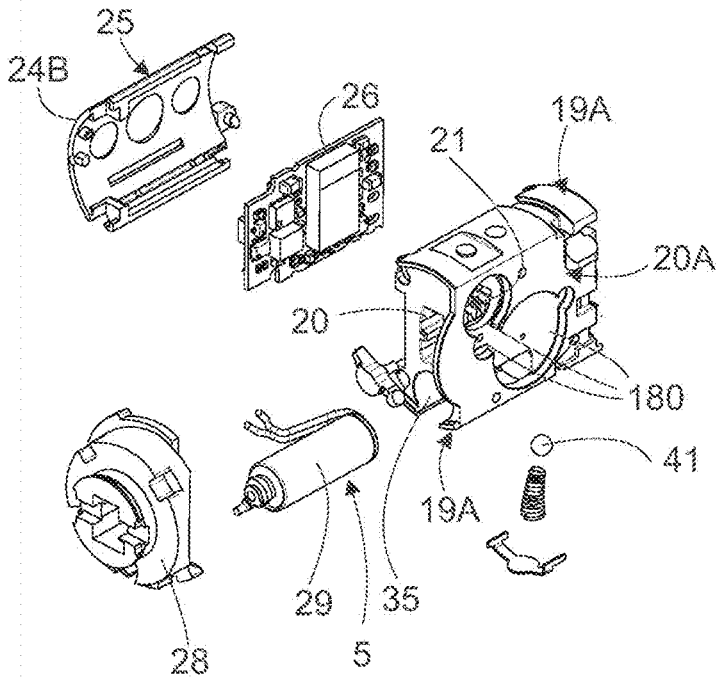
Figure 24:
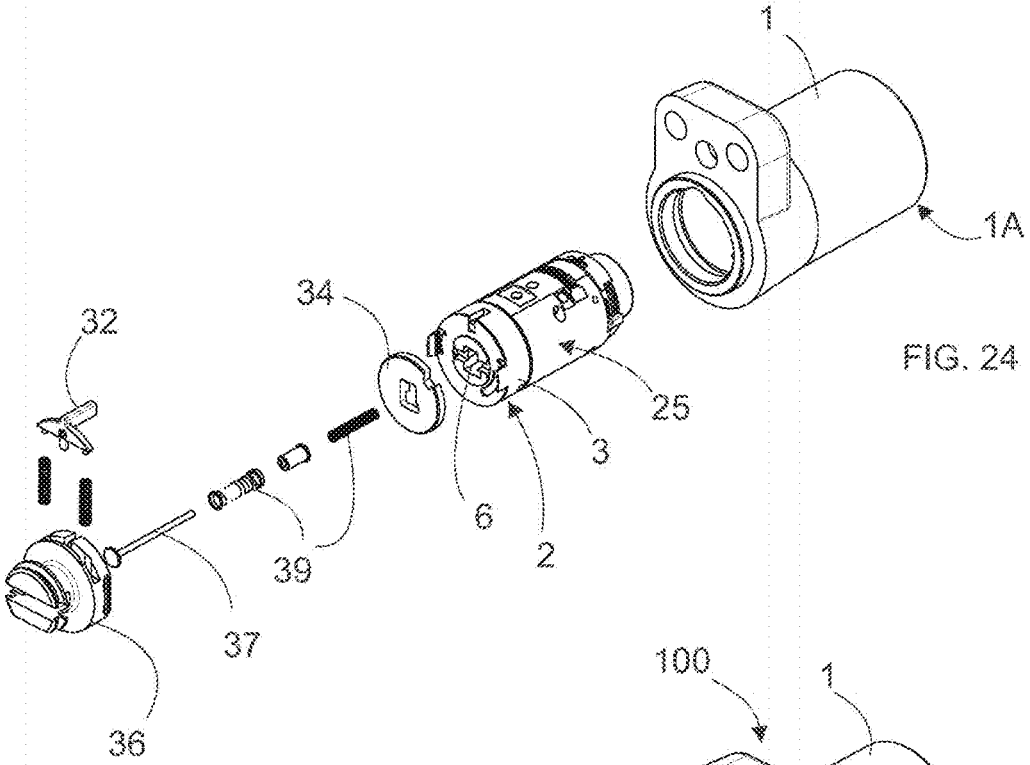
Figure 25:
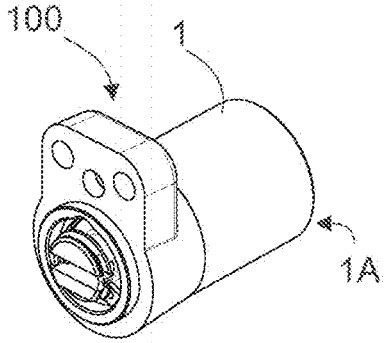

The invention is described in greater detail in the following, with reference to the accompanying drawing figures, wherein FIG. 1 shows an example of a cylinder lock according to the invention as an exploded view, FIG. 2 shows an example of a cylinder lock according to the invention when partly assembled, FIG. 3 shows an example of a generator module, FIG. 4 shows the generator module of FIG. 3 from another angle, FIG. 5 shows an example of a generator module as an exploded view, FIGS. 6 and 7 show yet another example of a generator module, FIGS. 8 and 9 show yet another example of a generator module, FIGS. 10 to 12 show an example of a key channel module, FIGS. 13 to 14 show an example of a toothed bar located in the key channel, FIGS. 15 to 16 show an example of a front shield of the cylinder lock according to the invention, FIGS. 17 to 18 show an example of an inner cylinder unit of the cylinder lock according to the invention, FIG. 19 shows a cross-sectional view of an example of the cylinder lock according to the invention with a key, FIG. 20 shows an example of the cylinder lock according to the invention with a disc tumbler, FIG. 21 shows an example of the cylinder lock according to the invention with a pin tumbler, FIG. 22 shows an example of the cylinder lock according to the invention as an exploded view, FIG. 23 shows certain parts of the invention in greater detail, FIG. 24 shows an example of the cylinder lock according to the invention when partly assembled, and FIG. 25 shows an example of the cylinder lock according to the invention when assembled.

DESCRIPTION OF THE INVENTION

FIG. 1 shows an example of the cylinder lock 100 according to the invention as an exploded view, and FIG. 2 when partly assembled.

The cylinder lock 100 comprises a body 1 and, inside it, an inner cylinder unit 2 which is provided with an inner cylinder 3, a tumbler 4 and electric means 5. The electric means allow the tumbler 4 to be guided from the locking position into the opening position. The tumbler 4 prevents the turning of the inner cylinder 3 with respect to the body 1 in the locking position and allows the inner cylinder to be turned with respect to the body in the opening position. FIG. 20 shows a disc tumbler 4 and FIG. 21 a pin tumbler 4A. Inside the inner cylinder is further a channel 6.

The cylinder lock also comprises a generator 7 for generating electricity from the movement of the key 8 inserted in the cylinder lock. The generator is comprised in a generator module 9 which is described in greater detail below. The electricity generated is used for identifying the key 8, and the electricity generated is further used in the electric means 5 if opening the cylinder lock 100 is allowed on the basis of the identification of the key.

FIGS. 3 and 4 show an example of a generator module. The generator module 9 thus comprises the said generator 7, the generator shaft system 10 in connection with the generator, the channel axis 11, and the transmission parts 12 from the channel axis to the generator. The generator module also includes two support plates 16A, 16B, between which the generator 7, the transmission parts 12, the generator shaft system 10 and the channel axis 11 are at least partly located. In at least one of the support plates is a hole 18 for the channel axis, and the channel axis 11 is positioned through the hole 18 intended for it such that a part of the channel axis is between the support plates and a part on the opposite side of one of the support plates. The channel axis 11 is arranged to rotate by the movement of the key 8 inserted in the cylinder lock.

The generator shaft system 10, the channel axis 11, the transmission parts 12 and the key channel module 19 are thus connected to the inner cylinder 3 such that they are arranged to turn with the inner cylinder.

The inner cylinder unit 2 includes a control unit 28 which comprises the said channel 6 and is provided with the said electric means 5. The control unit is also arranged to turn with respect to the inner cylinder 3. The electric means may be, for example, an electric motor 29. In the cylinder lock is also located a circuit board 26 provided with a memory to identify the key and, in addition, to convey the electricity generated to the electric means 5 if opening the cylinder lock is allowed on the basis of the identification of the key. FIGS. 17 and 18 also show an example of an inner cylinder unit.

FIG. 20 shows an example of a tumbler 4 located inside the inner cylinder 3. In this example, the tumbler is a disc tumbler, but in the arrangement may also be used a pin tumbler (FIG. 21). On the circumference of the disc tumbler is at least one notch 33 for a tumbler bar 32 (FIGS. 1 and 2). The example of FIG. 3 also shows how the electric motor 29 can be arranged to turn a lever 31 connected to the shaft 30 of the electric motor.

The lever 31 can be moved from a so-called neutral position into a power transmission position and vice versa. In the power transmission position, the tumbler 4 can be moved into an opening position, that is, in the example of FIG. 20, the lever 31 is in the edge recess 33A of the central hole of the tumbler 4. Thus, turning the key also causes the inner cylinder to turn. However, in a disc tumbler arrangement, the disc tumbler 4 turns before the inner cylinder turns such that the notch 33 on the circumference is at the tumbler bar 32. FIG. 20 also shows the channel 6 in the control unit 28.

FIG. 21 shows an example of a solution according to the invention using a pin tumbler. In this solution, the pin tumbler 4A prevents the turning of the inner cylinder 3A with respect to the body 2A in the locking position. The pin tumbler is located both in the notch 211 in the body and in a corresponding notch in the inner cylinder. The pin tumbler consists of two parts, which a spring 212 positioned in the notch 211 in the body pushes towards the inner cylinder 3A. The electric motor 29 located in conjunction with the inner cylinder 3A can be arranged to turn the lever 31 connected to the shaft 30 of the electric motor. The turning lever is able to guide the interface between the two parts of the pin tumbler to the border between the inner cylinder 3A and the body 2A, whereby the pin tumbler does not prevent the inner cylinder from being turned with respect to the body. FIG. 21 shows this type of a situation, that is, where the pin tumbler is guided into the opening position by means of the electric motor 29. FIG. 20 also shows the channel 6 in the inner cylinder/in its control unit 28.

In addition to a pin tumbler and a disc tumbler, it is also possible to implement other types of structures. The movement of the tumbler bar towards the centre of the cylinder lock can also be restricted or allowed, for example, by means of a separate lever/levers, which are not described in greater detail in this text. The tumbler is, therefore, not limited only to a disc or pin tumbler, but may also be some other embodiment.

FIGS. 1 and 2 also show that the cylinder lock comprises a rear part 36 which is connected in a non-turning manner to the inner cylinder 3. In the embodiment shown in the figures, the inner cylinder unit 2 also comprises a return tumbler disc 34 between the inner cylinder unit and the rear part 36 for returning the tumbler disc 4 to the normal position when the key is turned into the normal position. In the normal position, the key can be pulled out of the cylinder lock (and also be inserted into the lock). In both the pin tumbler embodiment and the disc tumbler embodiment, the electric means are guided into the neutral position, that is, the position in which the electric means do not guide the tumbler into the opening position or to be moved into the opening position, at the latest when the key has just been pulled out of the cylinder lock.

FIGS. 5 to 9 also show different embodiments of the generator module. The transmission parts 12 of the generator module 9 comprise shafts 13, 14. The generator module 9 may also comprise at least one double-flange pin 15 in some embodiments. The support plates 16A, 16B have holes 17 for the generator shaft system 10, the shafts 13, 14 and also for a possible flange pin or pins 15 or other types of pins. The mutual locations of the said holes 17 in both plates is predetermined. The double-flange pin 15 is located between the support plates 16A, 16B, while the flanges of the flange pin are against the support plates. The shafts 13, 14 and at least one flange pin 15 fix the support plates 16A, 16B to one another. From the examples can be seen that one of the said plates 16A, 16B may be smaller.

The said holes 17 in both plates have been made with a precision tool. The mutual locations of these holes are precise, and the shafts and flange pins can be placed precisely in the holes. FIGS. 3 and 5 show in dotted lines the distances between the holes 17, the distances thus also being precise.

Some generator module 9 embodiments may have at least one single-flange pin which acts as a shaft 13, 14 or a separate fixing pin between the plates. Double-flange and single-flange pins make the structure more robust. A more robust structure keeps its shape better and is, therefore, more durable and long-lasting. The precise mutual locations of the parts also keep better despite aging and wear.

The shafts 13, 14 and the flanged pins (the double-flange pin or the single-flange pin) may be laser-welded or pressed to the said plates. One of the said plates 16A, 16B may be smaller, as shown in the examples in the figures. The shafts of the transmission parts are provided with gears 13A, 14A, which are between the plates 16A, 16B. There are at least two transmission part shafts. Both the size of the plates and the number of shafts are arranged as desired to make the generator module 9 suitable for the cylinder lock.

The cylinder lock according to the invention also includes a key channel module 19 with a key channel 20 and an opening 21 from its side surface 20A into the key channel. FIGS. 10 to 12 show an example of a key channel module. The side surface forms a mainly planar surface against the generator module 9. The key channel 20 and the channel 6 inside the inner cylinder are located on the same axis, thus forming a joint channel 20, 6. It should, however, be noted that the axes of the key channel 20 and the channel 6 may also be misaligned, for example, because the channels are asymmetrical in different ways but still form a joint channel. A part of the channel axis 11 is positioned in the key channel module opening 21 and extends into the key channel 20. The channel axis 11 comprises a gearwheel 22 which is in the key channel 20. In this way, the channel axis is arranged to rotate by the movement of the key 8 inserted in the cylinder lock in the example embodiment described above. In the key channel module may be a space 35 for an electric motor 29.

The key channel module 19 may be made of one, two or even more parts. The parts may be, for example, laser-welded together if the module is made of at least two parts.

As shown in the example of FIGS. 10 to 12, the key channel module 19 may be asymmetrical with respect to the key channel, such that the key channel is located in the key channel module 19, closer to side 20A on the generator module 9 side. On the other side of the key channel module may further be positioned a circuit board 26 provided with a memory for identifying the key and, in addition, to convey the electricity generated to the electric means 5 if opening the cylinder lock is allowed on the basis of the identification of the key.

The cylinder lock comprises at least one curved protective cover 24A, between which protective cover and the key channel module 19 are located the channel axis 11 the transmission parts 12, the generator shaft system 10 and the generator 7.

In one embodiment, the cylinder lock comprises curved protective covers 24A, 24B, between which the generator module 9 and the key channel module 19 are located. Between the protective covers may also be located a circuit board 26. The protective covers form sliding support surfaces 25 with respect to the body 1. The support surfaces and the curved outer surface of the inner cylinder form a convergent curved surface area. The edges 19A of the key channel module 19 may further be curved, thus corresponding to the curvature of the outer surface of the inner cylinder.

The protective cover or protective covers may, therefore, be curved but they may also be of a different shape in order to protect the part/parts positioned under the protective cover/covers.

The installed generator module 9 is connected to the front shield 27 at the front part of the cylinder lock, the inner cylinder 3 and the key channel module 19. FIGS. 15 and 16 show an example of a front shield. The key channel module 19 includes a key channel 20 and an opening 21 from its side surface 20A into the key channel for the channel axis 11 part, as was already described above. The movement of the key is, therefore, transmitted to the channel axis and further through the transmission parts 12 to the generator 7. The generator thus generates electricity from the movement of the key. In the key channel module opening 21 is, therefore, positioned a part of the channel axis 11 which extends into the key channel 20. The channel axis 11 may comprise a gearwheel 22 which is in the key channel 20 and arranged to rotate by the movement of the key 8 inserted in the cylinder lock. The channel axis rotates also when the key is pulled out, thus causing also the generator to rotate.

In the embodiment shown, the cylinder lock comprises a toothed bar 23 which the key pushes when the key is inserted in the cylinder lock. FIGS. 13 and 14 show an example of a toothed bar. The toothed bar is located in the joint channel (20, 6) formed by the key channel and the channel (6) inside the inner cylinder. The toothed bar is also spring-loaded towards the front part 1A of the cylinder lock. The toothing of the toothed bar is against the gearwheel. Thus, the toothed bar 23 is in power transmission connection with the gearwheel 22 of the channel axis.

When the key is taken out of the cylinder lock, the spring/spring assembly in the cylinder lock pushes the toothed bar towards the front shield 27 of the cylinder lock. The front shield may consist of several parts. In an alternative embodiment, it may also be possible for the key to have a toothed section which settles against the gearwheel 22 when inserted, whereupon the movement of the key rotates the channel axis to produce electricity. As can be noted, electricity may also be generated when the key is pulled out of the cylinder lock.

As stated above, the cylinder lock comprises a rear part 36 which is connected in a non-turning manner to the inner cylinder 3. The rear part is located at the rear end 1B of the cylinder lock. The rear part may be provided with a pin 37 extending to the said joint channel 6, 20. The toothed bar 23 has a hole 38 for the pin, and around the pin is at least one spring 39 for pushing the toothed bar towards the front part 1A of the cylinder lock. In this way, the movement of the toothed bar is more controlled. FIGS. 1 and 2 also show the rings used for fastening at the back of the rear part.

The front shield 27 of the cylinder lock may include a sensing pin 40 to indicate the normal position of the key. The key channel module may further be provided with a retainer ball 41 for keeping the key 8 inserted in the cylinder lock in the cylinder lock before pulling the key out of the cylinder lock. This type of an embodiment is shown in FIG. 19.

It is also practical to have attachment surfaces/points in the key channel module for attaching the generator module, the circuit board, the protective covers, the front shield and the cylinder unit, and, correspondingly, the generator module, circuit board, protective covers, front shield and cylinder unit may have a counter-attachment surfaces/points.

FIG. 22 shows an exploded view of an example of another cylinder lock 100 according to the invention and FIG. 23 shows some parts of this embodiment in greater detail.

The cylinder lock 100 comprises a body 1 and, inside it, an inner cylinder unit 2 which is provided with an inner cylinder 3, a tumbler 4 and electric means 5. The electric means allow the tumbler 4 to be guided from the locking position to the opening position. The tumbler 4 prevents the turning of the inner cylinder 3 with respect to the body 1 in the locking position and allows the inner cylinder to be turned with respect to the body in the opening position. FIG. 20 shows a disc tumbler 4 and FIG. 21 a pin tumbler 4A. Inside the inner cylinder is further a channel 6. FIGS. 17 and 18 show the inner cylinder unit from different angles also in this embodiment of FIG. 22.

The cylinder lock also comprises a generator 7 for generating electricity from the movement of the key 8 inserted in the cylinder lock. The electricity generated is used for identifying the key 8, and the electricity generated is further used in the electric means 5 if opening the cylinder lock 100 is allowed on the basis of the identification of the key. The cylinder lock also comprises generator shaft system 10 in connection with the generator 7. The cylinder lock also comprises a channel axis 11 and transmission parts 12 from the channel axis to the generator. The channel axis 11 is arranged to rotate by the movement of the key 8 inserted in the cylinder lock. The inner cylinder unit 2 has a control unit 28 which comprises the said channel 6 and is provided with the said electric means 5. The control unit is also arranged to turn with respect to the inner cylinder 3. The electric means may be, for example, an electric motor 29.

The cylinder lock also comprises a key channel module 19 with a key channel 20 and an opening 21 from its side surface 20A into the key channel. On the side surface of the key channel module are recess formations 180 for the channel axis, the transmission parts, the generator shaft system and/or the generator.

The key channel 20 and the channel 6 inside the inner cylinder are positioned on the same axis and thus form a joint channel 20, 6 in which the key channel module opening 21 is positioned a part of the channel axis 11, which extends into the key channel 20. The channel axis 11 comprises a gearwheel 22 which is in the key channel 2 and arranged to rotate by the movement of the key 8 inserted in the cylinder lock.

The generator shaft system 10, the channel axis 11, the transmission parts 12 and the key channel module 19 are, therefore, connected to the inner cylinder 3 such that they are arranged to turn with the inner cylinder.

In the cylinder lock is also located a circuit board 26 provided with a memory for identifying the key, and also for conveying the electricity generated to the electric means 5 if opening the cylinder lock is allowed on the basis of the identification of the key.

The cylinder lock also comprises at least one curved protective cover 24A, between which protective cover and the key channel module 19 are located the channel axis 11, the transmission parts 12, the generator shaft system 10 and the generator 7.

In one embodiment, the cylinder lock comprises curved protective covers 24AA, 24B, between which the channel axis 11, the transmission parts 12, the generator shaft system 10 and the generator 7, as well as the key channel module 19 and the circuit board 26 are located, the protective covers forming sliding support surfaces 25 with respect to the body 1, and the support surfaces 25 and the outer surfaces of the inner cylinder forming a convergent curved surface area, and which second protective cover comprises second recess formations 170 for the channel axis 11, the transmission parts 12, the generator shaft system 10 and/or the generator. As already mentioned above, the protective cover/protective covers may be curved or also of a different shape.

FIG. 24 shows the embodiment of FIG. 22 when partly assembled, and FIG. 25 when completely assembled. As can be seen from the figures, the generator 7 may be preassembled with other parts (the key channel module, the circuit board) between the protective covers 24AA, 24B and connected in conjunction with the inner cylinder. No changes are necessarily required in the body 1. If the code of the key 8 inserted in the cylinder lock is correct, the inner cylinder 3 and the generator and the other parts between the protective covers are able to turn with respect to the body when the cylinder lock is opened.

FIGS. 20 and 21 show an embodiment with a pin tumbler and an embodiment with a disc tumbler which are also applicable to the cylinder lock in the example of FIG. 22.

FIG. 22 also shows that the cylinder lock comprises a rear part 36 which is connected in a non-turning manner to the inner cylinder 3. In the embodiment shown in the figures, the inner cylinder unit 2 also comprises a return tumbler disc 34 between the inner cylinder unit and the rear part 36 for returning the tumbler disc 4 into the normal position when the key is turned into the normal position. In the normal position, the key may be pulled out of the cylinder lock (and also inserted in the lock). In both the pin tumbler embodiment and the disc tumbler embodiment or other embodiment, the electric means are guided into neutral, that is, to a position in which the electric means do not guide the tumbler into the opening position, or to be moved into the opening position, at the latest when the key has just been pulled out of the cylinder lock.

FIG. 22 shows that the transmission parts 12 comprise shafts 13, 14. The shafts of the transmission parts are provided with gears 13A, 14A. There are at least two transmission part shafts. The number of shafts is arranged as desired to fit the cylinder lock.

The cylinder lock of FIG. 22 also includes a key channel module 19 with a key channel 20 and an opening 21 from its side surface 20A into the key channel. The side surface has recess formations 180 for the channel axis 11, the transmission parts 12, the generator shaft system 10 and/or the generator 7.

The key channel 20 and the channel 6 inside the inner cylinder are positioned on the same axis, thus forming a joint channel 20, 6. In the key channel module opening 21 is positioned a part of the channel axis 11, which extends into the key channel 20. The channel axis comprises a gearwheel 22 which is in the key channel 20. In this way, the channel axis is arranged to rotate by the movement of the key 8 inserted in the cylinder lock in the example embodiment described above. The key channel module may have a space 35 for an electric motor 29.

On the other side of the key channel module may further be located a circuit board 26 provided with a memory for identifying the key, and also for conveying the electricity generated to the electric means 5, if opening the cylinder lock is allowed on the basis of the identification of the key.

The cylinder lock also comprises at least one curved protective cover 24A, between which protective cover and the key channel module 19 are located the channel axis 11, the transmission parts 12, the generator shaft system 10 and the generator 7.

In one potential embodiment, the cylinder lock comprises curved protective covers 24AA, 24B, between which the generator 7 and the key channel module 19 are located. The circuit board 26 may also be located between the protective covers. The protective covers form sliding support surfaces 25 with respect to the body 1. The support surfaces 25 and the curved outer surface of the inner cylinder form a convergent curved surface area. In addition, the edges 19A of the key channel module 19 may be curved, thus corresponding to the curvature of the outer surface of the inner cylinder.

The installed generator 7 and the other parts between the protective covers are connected to the front shield 27 at the front part of the cylinder lock and to the inner cylinder 3. FIGS. 15 and 16 show an example of a front shield. As can be seen, the front shield 27 may be assembled of several parts. The key channel module 19 includes a key channel 20 and an opening 21 from its side surface 20AA into the key channel for the channel axis 11 part, as already mentioned above. The movement of the key is, therefore, transmitted to the channel axis and further through the transmission parts 12 to the generator 7. The generator thus generates electricity from the movement of the key. When assembled, in the key channel module opening 21 is, therefore, positioned a part of the channel axis 11 which extends into the key channel 20. The channel axis 11 may comprise a gearwheel 22 which is in the key channel 20 and arranged to rotate by the movement of the key 8 inserted in the cylinder lock. The channel axis rotates also when the key is pulled out, thus causing also the generator to turn.

Also in this embodiment, the cylinder lock comprises a toothed bar 23 which the key pushes when the key is inserted in the cylinder lock, as described above. FIGS. 13 and 14 show a toothed bar also for this embodiment. The key is removed from the cylinder lock as described above. Also in the embodiment of FIG. 22, it may be possible that the key has a toothed section which settles against the gearwheel 22 when inserted. The embodiment of FIG. 22 comprises a similar rear part 36 as the embodiment of FIG. 1. The structures of the front shield 27, the attachment surfaces/points and counter-attachment surfaces/points described above may also correspond to each other in both of the embodiments described above.

The solution according to the invention makes it possible to fit a generator to be connected to an inner cylinder such that the parts in conjunction with the generator, including the protective covers, form a cylindrical structure. This cylindrical structure can, in turn, be connected to the inner cylinder unit of the cylinder lock, such that it rotates either with the inner cylinder (such as the pin tumbler embodiments) and/or with the control unit 28 of the inner cylinder unit (such as the disc tumbler embodiments). The structure can also be connected to the front shield 27 and also fits inside the cylinder lock body 1, where it is able to turn with the inner cylinder with respect to the body when the tumbler (for example, a disc tumbler or a pin tumbler) of the inner cylinder unit does not prevent the turning. The structure according to the invention is, therefore, applicable for use in cylindrical lock bodies 1 and, in practice, no major, or any, modifications need to be made in the body 1. Due to this, the invention is applicable to various cylinder lock types and is relatively cost-effective to manufacture.

In addition, the solution according to the invention allows sheet-like structures to be fitted together to form a cylindrical structure. This cylindrical structure can, in turn, be connected to the inner cylinder unit of the cylinder lock such that it rotates either with the inner cylinder (such as the pin tumbler embodiments) and/or with the control unit 28 of the inner cylinder unit (such as the disc tumbler embodiments). The cylindrical structure made of sheet-like structures can also be connected to the front shield and also fits inside the cylinder lock body 1, where it is able to turn with the inner cylinder with respect to the body when the tumbler (for example, a disc tumbler or a pin tumbler) of the inner cylinder unit does not prevent the turning. The structure according to the invention is, therefore, applicable for use in cylindrical lock bodies 1 and, in practice, no major, or any, modifications need to be made in the body 1. This type of structure is also well suited for use in different cylinder lock types (e.g. DIN cylinders or Nordic cylinders).

The generator module according to the invention may be made, for example, in advance, in which case the actual assembly stage of the cylinder lock is simpler and quicker. In addition, manufacturing the generator module with small tolerances to achieve the precision requirements is simpler and cheaper than in earlier solutions. When the generator module is made to meet the precision requirements, for the other parts of the cylinder lock the precision requirements may be lower, thus reducing manufacturing costs. Furthermore, the generator module can be connected to the inner cylinder in such a way that it rotates with the inner cylinder when the lock cylinder is opened with a key. This type of structure is, in addition suitable for use with different lock cylinder types.

In the light of the above examples, it is obvious that the embodiment according to the invention can be achieved in many ways. It is clear that the invention is not limited merely to the examples disclosed in this text, but the invention may be implemented in various embodiments. Any inventive embodiment can, therefore, be implemented within the scope of the main claim.

The invention claimed is:

1. A cylinder lock, comprising a body and, inside it, an inner cylinder unit provided with an inner cylinder, a tumbler and electric means, which electric means allow the tumbler to be guided from a locking position into an opening position, the tumbler preventing the turning of the inner cylinder with respect to the body in the locking position and allowing the inner cylinder to be turned with respect to the body in the opening position, the inner cylinder having a channel inside it, the cylinder lock comprising a generator for generating electricity to the cylinder lock from the movement of a key inserted in the cylinder lock, the electricity generated being used to identify the key, and the electricity generated also being used in the electric means if opening the cylinder lock is allowed on the basis of the identification of the key, wherein the cylinder lock comprises, in connection with the generator, a generator shaft system, a channel axis and transmission parts from the channel axis to the generator, and a key channel module with a key channel and an opening from its side surface into the key channel, the key channel and the channel inside the inner cylinder forming a joint channel, in which key channel module opening is positioned a part of the channel axis, which extends into the key channel, and which channel axis comprises a gearwheel which is in the key channel and arranged to rotate by the movement of the key inserted in the cylinder lock, the generator shaft system, the channel axis, the transmission parts and the key channel module being in connection with the inner cylinder such that they are arranged to turn with the inner cylinder, and the cylinder lock comprises a circuit board provided with a memory for identifying the key, and also for conveying the electricity generated to the electric means if opening the cylinder lock is allowed on the basis of the identification of the key, and which cylinder lock comprises at least one protective cover, between which protective cover and the key channel module are located the channel axis, the transmission parts, the generator shaft system and the generator.

2. The cylinder lock according to claim 1, wherein it comprises a generator module which comprises the said generator and two support plates, between which the generator, the transmission parts, the generator shaft system and the channel axis are at least partly located, and in at least one of the support plates is a hole for the channel axis, and the channel axis is positioned through the hole intended for it such that a part of the channel axis is between the support plates and a part on the opposite side of one of the support plates, and the side surface of the key channel module forms a mainly planar surface against the generator module, and which generator module is between curved protective covers.

3. The cylinder lock according to claim 2, wherein transmission parts of the generator module comprise shafts, and the generator module also comprises at least one double-flange pin, and which support plates have holes for the generator shaft system, the shafts and for at least one flange pin, the mutual location of the said holes in both plates being predetermined, and the flange pin is located between the support plates, while the flanges of the flange pin are against the support plate, the shafts and at least one flange pin fixing the support plates to one another.

4. The cylinder lock according to claim 3, wherein the said holes in both plates have been made with a precision tool.

5. The cylinder lock according to claim 3, wherein the generator module comprises at least one single-flange pin which acts as a shaft or a separate fixing pin between the plates.

6. The cylinder lock according to claim 4, wherein the shafts and at least one double-flanged pin are laser-welded or pressed to the said plates.

7. The cylinder lock according to claim 2, wherein one of the said plates is smaller.

8. The cylinder lock according to claim 2, wherein the key channel module is asymmetrical with respect to the key channel, such that the key channel is located in the key channel module closer to the side on the generator module side.

9. The cylinder lock according to claim 2, wherein a toothed bar is located in the joint channel formed by the key channel and the channel inside the inner cylinder, the toothed bar being spring-loaded towards the front part of the cylinder lock, the toothed bar being in power transmission connection with the gearwheel of the channel axis.

10. The cylinder lock according to claim 2, wherein at the front part of the cylinder lock is a front shield which is connected to the key channel module.

11. The cylinder lock according to claim 3, wherein the shafts of the transmission parts are provided with gears, which are between the plates.

12. The cylinder lock according to claim 11, wherein there are at least two shafts of the transmission parts.

13. The cylinder lock according to claim 2, wherein the inner cylinder unit includes a control unit which comprises the said channel and is provided with the said electric means and arranged to turn with respect to the inner cylinder.

14. The cylinder lock according to claim 13, wherein the electric means is an electric motor and its shaft, to which shaft is connected a lever which can be moved by the electric motor from the neutral position into a power transmission position and vice versa, in which power transmission position the tumbler can be moved into the opening position.

15. The cylinder lock according to claim 14, wherein the cylinder lock further comprises a tumbler bar, and the said tumbler is a disc tumbler, on the circumference of which is a notch for the tumbler bar.

16. The cylinder lock according to claim 15, wherein the inner cylinder unit also comprises a return tumbler disc for returning the tumbler disc to the normal position when the key is turned into the normal position.

17. The cylinder lock according to claim 2, wherein the said tumbler is a pin tumbler and the electric means is an electric motor and its shaft, to which shaft is connected a lever which can be moved from the neutral position into a power transmission position and vice versa, in which power transmission position the pin tumbler has moved into the opening position.

18. The cylinder lock according to claim 2, wherein the circuit board is located on one side of the key channel module, between the protective covers.

19. The cylinder lock according to claim 2, wherein the other side of the key channel module towards the circuit board is mainly planar.

20. The cylinder lock according to claim 19, wherein the edges of the key channel module are curved, corresponding to the curvature of the outer surface of the inner cylinder.

21. The cylinder lock according to claim 14, wherein the key channel module has a space for the electric motor.

22. The cylinder lock according to claim 9, wherein the cylinder lock comprises a rear part which is connected in a non-turning manner to the inner cylinder, and which rear part is provided with a pin extending to the said joint channel, and which toothed bar has a hole for the pin and around the pin is at least one spring for pushing the toothed bar towards the front part of the cylinder lock.

23. The cylinder lock according to claim 2, wherein the front shield has a sensing pin to indicate the normal position of the key.

24. The cylinder lock according to claim 2, wherein the key channel module includes a retainer ball for keeping the key inserted in the cylinder lock in the cylinder lock before pulling the key out of the cylinder lock.

25. The cylinder lock according to claim 2, wherein the key channel module has attachment surfaces/points for attaching the generator module, the circuit board, the protective covers, the front shield and the cylinder unit; and the generator module, circuit board, protective covers, front shield and cylinder unit have counter-attachment surfaces/points.

26. The cylinder lock according to claim 1, wherein on the side surface of the key channel module are recess formations for the channel axis, the transmission parts, the generator shaft system and/or the generator, and in which second protective cover are second recess formations for the channel axis, the transmission parts, the generator shaft system and/or the generator.

27. The cylinder lock according to claim 26, wherein the transmission parts comprise shafts, which shafts are provided with gears.

28. The cylinder lock according to claim 26, wherein a toothed bar is located in the joint channel formed by the key channel and the channel inside the inner cylinder, the toothed bar being spring-loaded towards the front part of the cylinder lock, the toothed bar being in power transmission connection with the gearwheel of the channel axis.

29. The cylinder lock according to claim 26, wherein at the front part of the cylinder lock is a front shield which is connected to the key channel module.

30. The cylinder lock according to claim 26, wherein there are at least two shafts of the transmission parts shafts.

31. The cylinder lock according to claim 26, wherein the inner cylinder unit includes a control unit which comprises the said channel and is provided with the said electric means and arranged to turn with respect to the inner cylinder.

32. The cylinder lock according to claim 31, wherein the electric means is an electric motor and its shaft, to which shaft is connected a lever which can be moved by the electric motor from the neutral position into a power transmission position and vice versa, in which power transmission position the tumbler can be moved into the opening position.

33. The cylinder lock according to claim 32, wherein the cylinder lock further comprises a tumbler bar, and the said tumbler is a disc tumbler, on the circumference of which is a notch for the tumbler bar.

34. The cylinder lock according to claim 33, wherein the inner cylinder unit also comprises a return tumbler disc for returning the tumbler disc to the normal position when the key is turned into the normal position.

35. The cylinder lock according to claim 26, wherein the said tumbler is a pin tumbler and the electric means is an electric motor and its shaft, to which shaft is connected a lever which can be moved from the neutral position into a power transmission position and vice versa, in which power transmission position the pin tumbler has moved into the opening position.

36. The cylinder lock according to claim 26, wherein the circuit board is located on the other side of the key channel module, the other side towards the circuit board being mainly planar.

37. The cylinder lock according to claim 36, wherein the edges of the key channel module are curved, corresponding to the curvature of the outer surface of the inner cylinder.

38. The cylinder lock according to claim 32, wherein the key channel module has a space for the electric motor.

39. The cylinder lock according to claim 26, wherein the cylinder lock comprises a rear part which is connected in a non-turning manner to the inner cylinder, and which rear part is provided with a pin extending to the said joint channel, and a toothed bar has a hole for the pin, and around the pin is at least one spring for pushing the toothed bar towards the front part of the cylinder lock.

40. The cylinder lock according to claim 26, wherein a front shield has a sensing pin to indicate the normal position of the key.

41. The cylinder lock according to claim 26, wherein the key channel module includes a retainer ball for keeping the key inserted in the cylinder lock in the cylinder lock before pulling the key out of the cylinder lock.

42. The cylinder lock according to claim 26, wherein the key channel module has attachment surfaces/points for attaching the generator module, the circuit board, the protective covers, the front shield and the cylinder unit; and the circuit board, protective covers, front shield and cylinder unit have counter-attachment surfaces/points.

43. The cylinder lock according to claim 1, wherein the cylinder lock also comprises a second protective cover, between which protective covers are located the channel axis, the transmission parts, the generator shaft system and the generator, as well as the key channel module.

44. The cylinder lock according to claim 43, wherein the protective covers form sliding support surfaces with respect to the body, and the support surfaces and the outer surfaces of the inner cylinder form a convergent curved surface area.

* * * * *